US007294100B2

(12) United States Patent
Bull

(10) Patent No.: US 7,294,100 B2
(45) Date of Patent: Nov. 13, 2007

(54) STRETCHING AND EXERCISE APPARATUS

(75) Inventor: Tommy Bull, Newport Beach, CA (US)

(73) Assignee: High Kick Productions, Inc., Las Vegas, NV (US)

( * ) Notice: Subject to any disclaimer, the term of this patent is extended or adjusted under 35 U.S.C. 154(b) by 46 days.

(21) Appl. No.: 10/978,963

(22) Filed: Nov. 1, 2004

(65) Prior Publication Data

US 2005/0187086 A1 Aug. 25, 2005

Related U.S. Application Data

(60) Provisional application No. 60/516,880, filed on Nov. 3, 2003.

(51) Int. Cl.
*A63B 22/00* (2006.01)
*A63B 69/18* (2006.01)

(52) U.S. Cl. ..... 482/907; 482/51; 482/70

(58) Field of Classification Search ..... 482/907, 482/70, 71, 133, 138, 79, 80, 51
See application file for complete search history.

(56) References Cited

U.S. PATENT DOCUMENTS

| | | | | |
|---|---|---|---|---|
| 3,589,720 | A * | 6/1971 | Agamian | 482/114 |
| 4,046,373 | A * | 9/1977 | Kim | 482/42 |
| 4,506,884 | A * | 3/1985 | Hankin | 482/131 |
| 4,826,158 | A | 5/1989 | Fields, Jr. | |
| 4,884,802 | A * | 12/1989 | Graham | 482/130 |
| 4,915,378 | A | 4/1990 | Abrahamian et al. | |
| 4,964,629 | A | 10/1990 | Wright | |
| 5,209,711 | A * | 5/1993 | Scrima | 482/70 |
| 5,224,909 | A | 7/1993 | Hamilton | |
| 5,241,952 | A | 9/1993 | Ortiz | |
| 5,261,865 | A | 11/1993 | Trainor | |
| 5,295,935 | A * | 3/1994 | Wang | 482/130 |
| 5,328,427 | A * | 7/1994 | Sleamaker | 482/71 |
| 5,338,278 | A * | 8/1994 | Endelman | 482/142 |
| 5,417,634 | A | 5/1995 | Habing | |
| 5,518,483 | A * | 5/1996 | Oswald | 482/131 |
| 5,520,598 | A * | 5/1996 | Little | 482/79 |
| 5,735,773 | A | 4/1998 | Vittone et al. | |
| 5,842,960 | A * | 12/1998 | Yu | 482/131 |
| 5,941,803 | A | 8/1999 | Chamberlain et al. | |
| 6,203,473 | B1 | 3/2001 | Atwood | |
| 6,368,254 | B1 | 4/2002 | Wall | |
| 6,440,045 | B1 * | 8/2002 | Gaston | 482/140 |
| 6,935,992 | B2 * | 8/2005 | Gehrke | 482/146 |
| 2003/0032534 | A1 * | 2/2003 | McAfee, Jr. | 482/133 |
| 2003/0216230 | A1 * | 11/2003 | Wang | 482/123 |
| 2004/0053752 | A1 | 3/2004 | Yang | |

* cited by examiner

FOREIGN PATENT DOCUMENTS

| | | |
|---|---|---|
| AU | B-79048/87 | 3/1988 |

OTHER PUBLICATIONS

PCT Written Opinion of the International Search Authority and PCT International Search Report, dated Feb. 10, 2005.

*Primary Examiner*—Stephen R. Crow
*Assistant Examiner*—Allana Lewin
(74) *Attorney, Agent, or Firm*—Knobbe Martens Olson & Bear LLP

(57) ABSTRACT

A stretching and exercise apparatus comprises at least one track member. The apparatus further comprises a pair of sliding platforms engaged to the at least one track member, wherein the platforms are configured to freely slide along the track member. The apparatus further comprises a pair of hand rails.

12 Claims, 15 Drawing Sheets

STRETCHING AND EXERCISE APPARATUS

RELATED APPLICATIONS

This application claims priority under 35 U.S.C. §119(e) to U.S. Provisional Application No. 60/516,880, filed on Nov. 3, 2003, the entirety of which is hereby incorporated by reference.

BACKGROUND OF THE INVENTION

1. Field of the Invention

This invention relates generally to exercising and stretching equipment, and more particularly, to a combination stretching and exercise apparatus.

2. Description of the Related Art

In order to optimally exercise and remain in a healthy condition, it is necessary for one to possess not only strength and stamina, but flexibility as well. Total body training is one method of improving these three areas of fitness, and is directed, in part, to muscles of the center, or core, of the body. The "core" is a pathway through the center of one's body by which energy can flow freely through the interior muscles of the body to perform desired body activities. When a person performs from the "core", maximum power and control are exerted over body movement, and body movement becomes more efficient.

Conventional exercising typically involves passive stretching of sets of muscles substantially in isolation from one another and frequently beyond their natural ranges. The potential for injury is thereby increased. Conventional strengthening devices typically comprise either free weights or weight machines that target certain muscles or muscle groups sought to be strengthened. These strength devices often place the body in unnatural positions, place unnecessary stress on the user's joints and back, and are more useful for building mass than strength. Often, such machines are also designed to require a high base level of fitness, making them unsuitable for the novice athlete.

Conventional cardiovascular machines typically comprise stationary machines, such as: treadmills, stair climbers, rowing machines, and stationary bicycles. While generally effective at increasing cardiopulmonary conditioning by increasing the heart rate and lung capacity, such devices restrict the user thereof to engage in a single repetitious activity having a limited range of motion. As a consequence, this class of exercise equipment fails to place any emphasis on flexibility, let alone develop and strengthen muscles and muscle groups that necessarily must possess such flexibility.

In contrast, total body training involves dynamic stretching of different muscle systems together such that the whole body is supporting the movement and the natural range of muscle stretching is not exceeded. Power is thereby increased, and the potential for injury is reduced, as strengthening and stretching are performed at the same time. There is currently lacking in the art any type of stretching and exercise device that develops and improves flexibility of the legs, and more particularly the soleus, gastrocnemius, semitendinosus, biceps, femoris, rectus femoris, gracilis, adductor longus, adductor magnus, and vastus medialis muscles thereof, while employing the principles of total body training. There is further lacking in the art any such device that, in addition to improving flexibility, further strengthens and tones all of the body's major muscle groups.

Accordingly, there is a need in the art for a stretching and exercise device, which may further be utilized as a strength-building total body training machine capable of being utilized for a variety of exercises as well as for cardiopulmonary conditioning.

Still further, there is a need for a stretching and exercise device that uses the individual's own resistance to control the intensity of the movement. Use of the body's own resistance on the equipment helps improve the user's natural balance to enhance strength, grace and movement, and to reduce the potential for injury.

SUMMARY OF THE INVENTION

The present invention specifically addresses the above-identified deficiencies in the art. In this regard, the present invention is directed to a hybrid stretching and exercise machine that substantially increases flexibility and strength in a user's legs, and in particular in the soleus, gastrocnemius, semitendinosus, biceps, femoris, rectus femoris, gracilis, adductor longus, adductor magnus, and vastus medialis muscles thereof, and that further can be utilized to perform a variety of total body strengthening exercises that may particularly strengthen the user's core.

According to a preferred embodiment, the stretching and exercise apparatus comprises at least one track member. The apparatus further comprises a pair of sliding platforms engaged to the at least one track member, wherein the platforms are configured to freely slide along the track member. The apparatus further comprises a pair of hand rails.

In accordance with one preferred embodiment of the present invention, a stretching and exercise apparatus is disclosed. The apparatus comprises an elongate track member with an elongate slot, a stabilizing member substantially perpendicular to and affixed to the elongate track member, a pair of platforms slidably engaged to the elongate track member, wherein at least one of the platforms has a pair of hand grips, and a pair of hand rails substantially parallel with the elongate track member and having an adjustable height relative to the elongate track member.

In accordance with another preferred embodiment of the present invention, another stretching and exercise apparatus is disclosed. The apparatus comprises two elongate track members extending substantially parallel to one another, two sliding platforms slidably engaged to the two elongate track members, which sliding platforms slide substantially co-linearly, and two hand rails, each hand rail comprising at least one vertical portion and a substantially horizontal, raised portion.

In accordance with another preferred embodiment of the present invention, another stretching and exercise apparatus is disclosed. The apparatus comprises a proximal-anterior-elongate track member, and a distal-anterior elongate track member arranged in a co-linear fashion to the proximal-anterior elongate track member, such that one end of the distal-anterior elongate track member substantially abuts one end of the proximal-anterior elongate track member. The apparatus further comprises a proximal-posterior elongate track member extending substantially parallel to the proximal-anterior elongate track member, and a distal-posterior elongate track member extending substantially parallel to the distal-anterior elongate track member, and arranged in a co-linear fashion to the proximal-posterior elongate track member, such that one end of the distal-posterior elongate track member substantially abuts one end of the proximal-posterior elongate track member. The apparatus further comprises a proximal sliding platform slidably engaged between the proximal-anterior elongate track member and the proximal-posterior elongate track member, and a distal sliding platform slidably engaged between the distal-anterior elongate track member and the distal-posterior elongate track member. An anterior hand rail is provided having one anterior horizontal portion, which anterior horizontal portion is supported by a first anterior vertical portion connecting to the proximal-anterior elongate track member, and by a second anterior vertical portion connecting to the distal-anterior elongate track member, and a posterior hand rail is provided having one posterior horizontal portion, which posterior horizontal portion is supported by a first posterior vertical portion connecting to the proximal-posterior elongate track member, and by a second posterior vertical portion connecting to the distal-posterior elongate track member.

In accordance with one embodiment of the present invention, a method of stretching and exercising for a user is disclosed. This method comprises providing an apparatus having an elongate track member, a pair of platforms engaged with the elongate track member, and a pair of hand rails, wherein said platforms are free sliding. The method further comprises moving the platforms away from one another, and moving the platforms toward one another.

Figure 1:
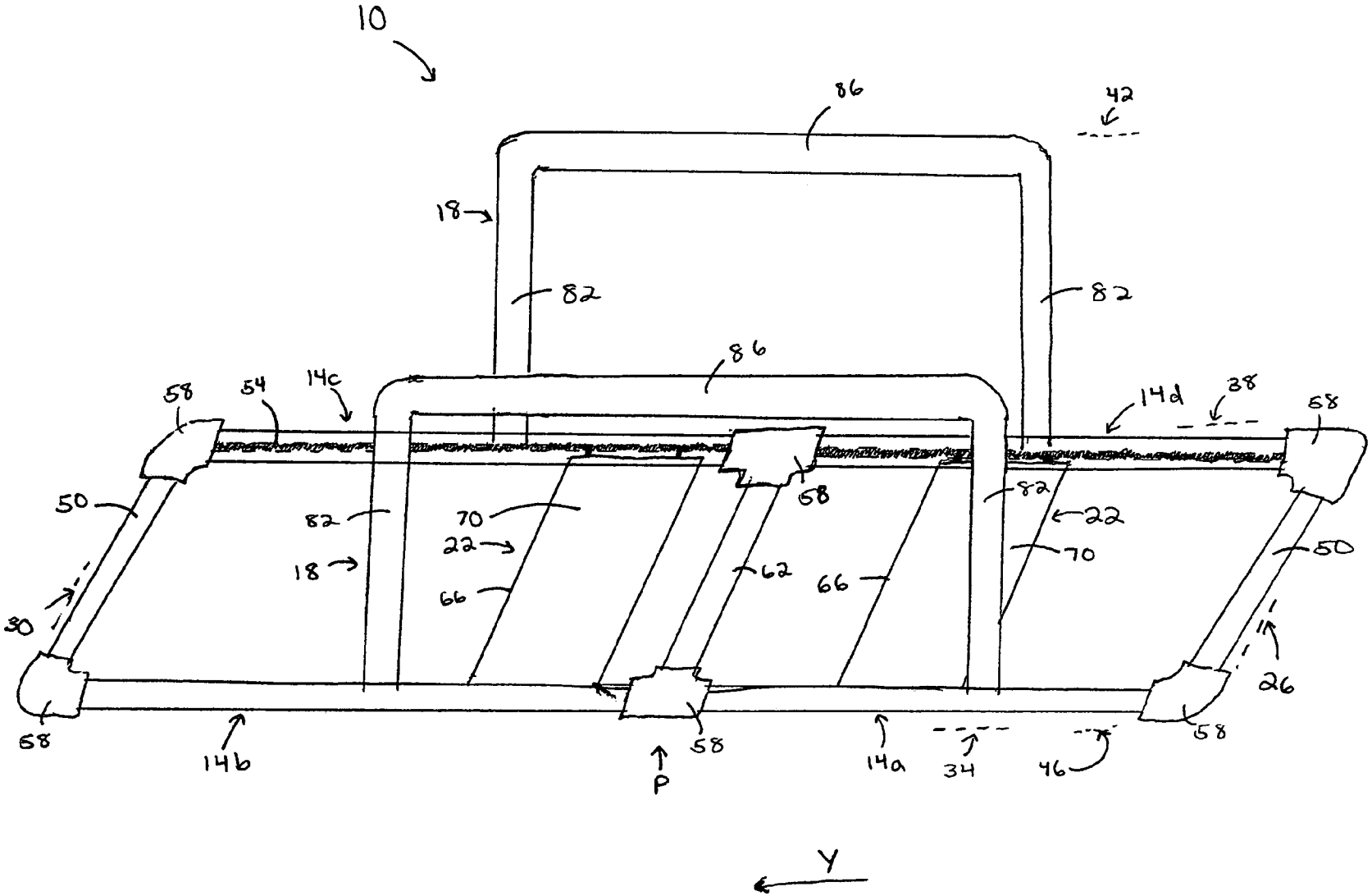
FIG. 1 is a perspective view of a preferred embodiment of the stretching and exercising apparatus.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION OF THE PREFERRED EMBODIMENT

FIG. 1 illustrates an embodiment of a stretching and exercise apparatus 10 as seen from a perspective view. As illustrated, the apparatus 10 comprises one or more track members 14, a pair of hand rails 18, and a pair of sliding platforms 22. The apparatus is formed to have a proximal side 26, a distal side 30, a midpoint P between those two sides, an anterior side 34, a posterior side 38, and a superior side 42 and inferior side 46.

Figure 2:
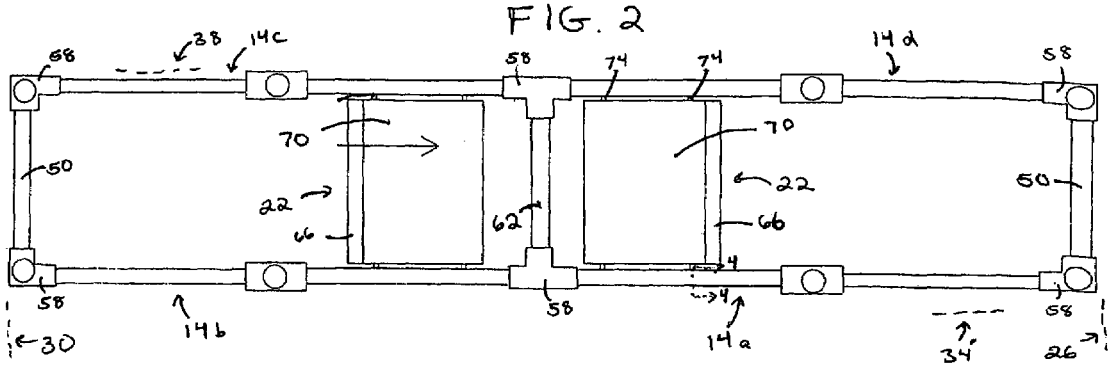
FIG. 2 is a top view of a preferred embodiment of the stretching and exercising apparatus.

In one embodiment, shown in FIGS. 1 and 2, the apparatus 10 comprises four track members 14*a*, 14*b*, 14*c*, 14*d*, formed as elongated cylinders laid parallel with the apparatus' longitudinal axis Y running from the proximal side 26 to the distal side 30. Stabilizing members 50 may further be configured between the track members 14*a*, 14*d* and 14*b*, 14*c* at the proximal and distal sides 26, 30 of the apparatus 10. These stabilizing members 50 may also be formed as parallel, elongated cylinders in one embodiment.

The track members 14 may further comprise rigid tubing configured to receive some portion of the sliding platforms 22 therein. For example, the track members 14 may be constructed of polyvinyl chloride ("PVC") piping with a slot 54 running down their longitudinal axes, which slot 54 is shaped and configured to accept a portion of the sliding platforms 22, as further described below.

In another embodiment, the apparatus 10 may comprise two, rather than four, parallel track members 14 extending substantially the entire length of the exercise apparatus 10. In still another embodiment, the track members 14 may comprise two parallel rails along which the sliding platforms 22 are adapted to slide. The rails may be elongate, rectangular beams, similar in construction to train tracks. In alternative embodiments, the track members 14 may comprise one or more parallel grooves or other guide means configured to engage the sliding platforms 22. In other embodiments, other shapes, sizes and numbers of the track members 14 may be used, which track members 14 provide a slidable connection and guide for the sliding platforms 22. In a preferred embodiment, the track members 14 are further configured to facilitate separation, to make the apparatus 10 readily portable and storable.

The track members 14 may further define a number of linear or curvilinear shapes and sizes that are adapted to slidably engage and guide the sliding platforms 22. In one embodiment, the track members 14 define a substantially straight line from the proximal side 26 to the distal side 30. However, in other embodiments, the track members 14 on either side of the midpoint P may form oval or other elliptical configurations.

The length of the apparatus 10 from proximal side 26 to distal side 30 is preferably chosen so that the sliding platforms 22 can separate as far as it is possible for a user's feet to separate. In one embodiment, this length may be between eight and 10 feet, to accommodate a wide range of heights and ranges of flexibility. In a preferred embodiment, this length may be adjustable by the user, by, for example, using track members 14 of adjustable length. The track members 14 may be configured to connect to other track members 14 to extend their length or may comprise telescoping cylinders. The length of adjacent track members 14*a*, 14*b* may be chosen to extend substantially the entire length of the apparatus 10. In the illustrated embodiment, the track members 14*a*, 14*b*, 14*c*, 14*d* are approximately 4 feet long, separated by track connectors 58. These track connectors 58 may be hollow tubing of a larger diameter than the track members 14*a*, 14*b*, 14*c*, 14*d*, such that the track members 14 can easily mate with the track connectors 58. In one embodiment, these track connectors 58 facilitate the easy disassembly of the apparatus 10.

In one embodiment, the co-linear track members 14*a*, 14*b* and 14*d*, 14*c* are joined near the apparatus' midpoint P by track connectors 58, and a stabilizing and dividing member 62 may extend between the parallel track members 14 at this midpoint P. In this embodiment, illustrated in FIGS. 1 and 2, the track members 14*a*, 14*b*, 14*c*, 14*d* are substantially parallel to each other, and sets of track members 14*a*, 14*b* and 14*d*, 14*c* are arranged in a generally co-linear fashion.

The stabilizing members 50, 62 may improve the apparatus' 10 rigidity, allowing the track members 14 to withstand greater stresses during exercise. The stabilizing and dividing member 62 further functions to divide the track members 14*a*, 14*b* and 14*d*, 14*c* and to stabilize the track connectors 58. As further described below, this division limits the sliding platforms' range of motion, and prevents their collision as they approach the midpoint P.

As illustrated in FIG. 2 from a top view, the apparatus 10 comprises sliding platforms 22 configured to slidably engage with the track member or members 14. Each sliding platform 22 comprises a main body portion 66. This main body portion 66 supports a foot-receiving surface 70 facing the superior side 42 of the apparatus 10, which surface 70 is preferably textured to provide great traction. The foot-receiving surface 70 may be sized to receive one foot placed such that the toes face in the anterior direction and the heel faces in the posterior direction. The surface 70 may be further configured to receive two feet placed side by side thereon such that the toes face the proximal side 26 of the apparatus 10. The surface 70 may be further configured to receive a user's knees placed side by side thereon. In one embodiment, the foot-receiving surface 70 may be at least a foot wide in both the proximal to distal direction and anterior to posterior direction.

In the illustrated embodiment, one of the sliding platforms 22 slidably engages two of the parallel track members 14*a*, 14*d*, and the other sliding platform 22 slidably engages another two of the parallel track members 14*b*, 14*c*. In this embodiment, the sliding platforms 22 are separated by the stabilizing and dividing member 62 and are, in part, prevented from sliding past the proximal and distal sides 26, 30 of the apparatus 10 by the stabilizing members 50. As they are slidably engaged with track members 14*a*, 14*b*, 14*c*, 14*d*, the sliding platforms 22 have a range of motion between the proximal or distal sides 26, 30 of the apparatus 10 and the midpoint P. Other configurations of the track members 14 and sliding platforms 22 are, of course, possible, as is well known to those of skill in the art.

The slidable connection between the sliding platforms 22 and the track member or members 14 may be provided in a number of ways. In one embodiment, shown most clearly in FIG. 2, the main body portions 66 of the sliding platforms 22 have a narrower width than the anterior-posterior width separating parallel track members 14*a*, 14*d*. The sliding platforms 22 may further comprise pegs 74 extending towards the anterior and posterior sides 34, 38 of the apparatus 10, which pegs 74 may be configured to engage the track members 14.

Figure 4:
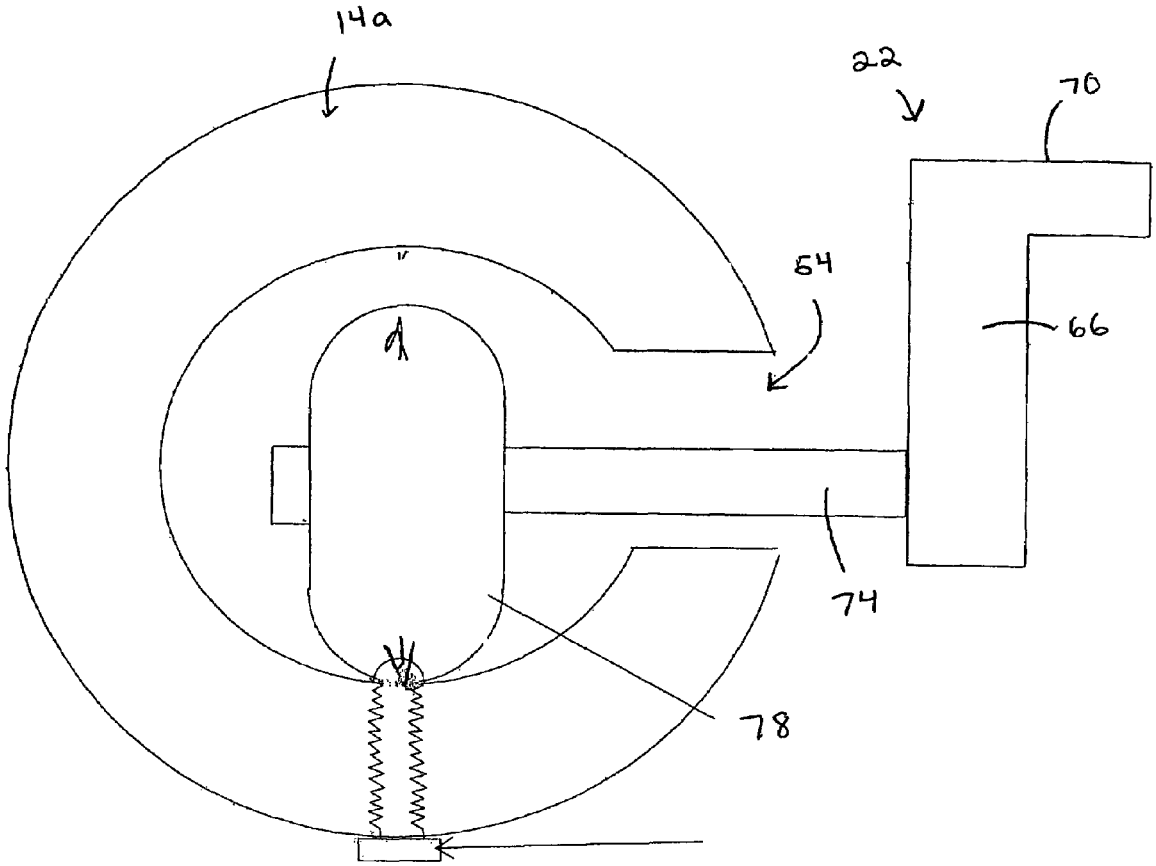
FIG. 4 is an expanded cross-sectional view along line 4 of FIG. 2 showing one preferred embodiment of the sliding mechanism of the sliding platform.

As shown in FIG. 4, a detailed cross-section of an example assembly, the track member 14*a* may comprise a hollow cylinder with a slot 54 disposed from its proximal to distal end. A peg 74 may be configured to fit and slide within this slot 54. In one embodiment, the peg 74 may simply be a solid bar or pin extending from the main body portion 66 of the sliding platform 22. This solid bar or pin can provide a low friction engagement (not shown) with the track member 14*a* and may be disposed within (as described above) or on top of the track member 14*a* (e.g., with a rail-type configuration). In the illustrated embodiment, the peg 74 further comprises a wheel 78 configured to rotate about the peg 74. This wheel 78 may turn within the hollow cylinder 14*a* to provide a slidable connection between the sliding platform 22 and track member 14*a*. Such wheels may be configured to sit atop the track members 14, or, as illustrated, the wheels may be enclosed within the track members' cylindrical passage.

Figure 3:
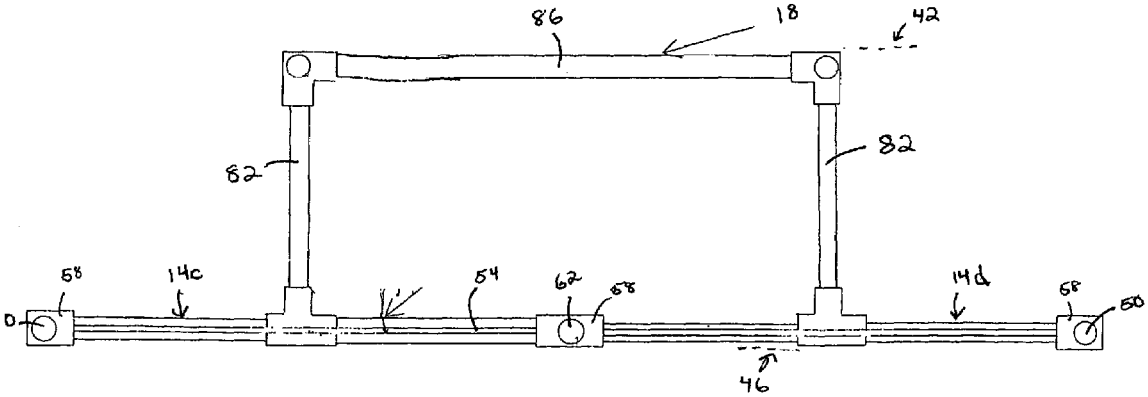
FIG. 3 is an inner side view of a preferred embodiment of the stretching and exercising apparatus.

In one embodiment, the apparatus 10 further comprises a pair of hand rails 18 extending substantially parallel with the track members 14*a*, 14*b*, 14*c*, 14*d*. As illustrated in FIG. 3, in one embodiment, each hand rail 18 may comprise a pair of substantially vertical portions 82, extending from the inferior to superior 46, 42 side of the apparatus 10, supporting a substantially horizontal, raised portion 86, extending between the proximal and distal sides 26, 30 of the apparatus 10. In one embodiment, a vertical portion 82 may connect between a track member 14*a* and the raised portion 86, another vertical portion 82 may connect between a track member 14*b* and the raised portion 86, and the raised portion 86 may lie parallel to the track members 14*a*, 14*b*. In other embodiments, more or fewer vertical portions 82 may be used to support the raised portion 86, and these vertical portions 82 may or may not be directly connected to the track members 14. In one preferred embodiment, the vertical portions 82 partially define the anterior and posterior sides 34, 38 of the apparatus 10 and lie further anteriorly than the track members 14*a*, 14*b*, and further posteriorly than the track members 14*c*, 14*d*. As shown in FIG. 3, the raised portion 86 may be parallel with only a portion of the track members 14 and may be substantially shorter than the length from proximal to distal side 26, 30 of the apparatus 10. In other embodiments, the raised portion 86 of the hand rails 18 may be longer than, or substantially the same length as the length from proximal to distal side 26, 30 of the apparatus 10.

The hand rails 18 may preferably be constructed similarly to the track members 14. In one embodiment, the hand rails 18 comprise elongated hollow cylinders made from PVC piping. Of course, in other embodiments, the hand rails 18 may be constructed from a variety of materials durable enough to support a user's weight. In another embodiment, the hand rails 18 may be easily separable from the main body of the apparatus 10 to facilitate storage and portability.

In one embodiment, the vertical portions 82 of the hand rails 18 are between 2 and 3 feet long, raising the raised portion 86 by this height to define the superior edge of the apparatus 10. This height may be chosen to accommodate a number of different users and may be further adjustable to accommodate a wider range of possible users' heights. As will be described in further detail below, the height of the hand rails 18 may be chosen to facilitate the various exercises and stretches that are possible with the apparatus 10. More hand rails 18 may also be used in different configurations to provide varying levels of support and to facilitate different exercises.

Figure 5A:
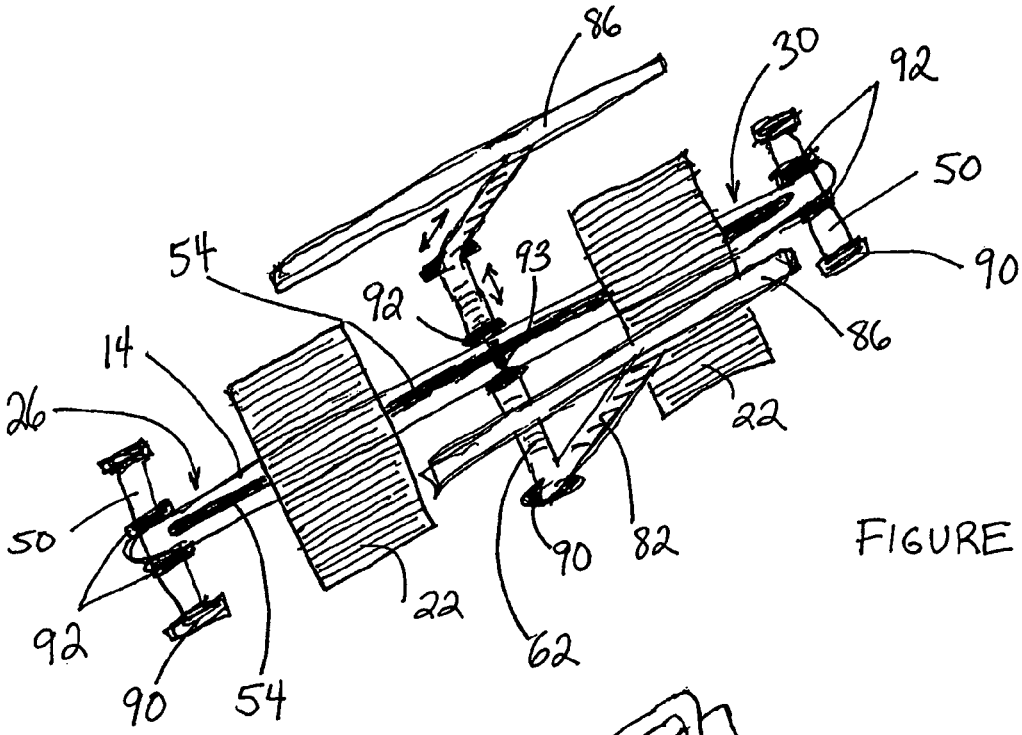
FIG. 5A is a perspective view of another embodiment of stretching and exercise apparatus having a single track member.
Figure 5B:
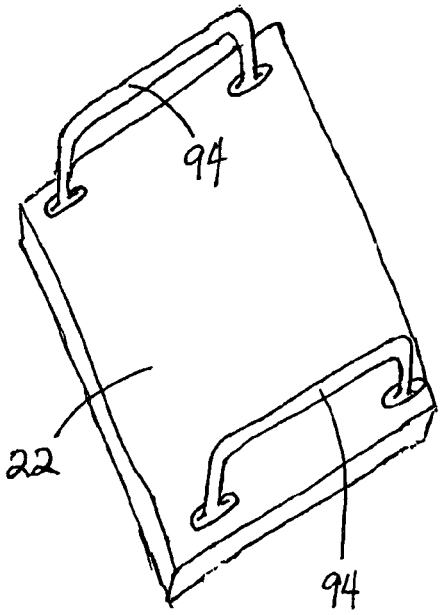
FIG. 5B is a perspective view of a variation to the sliding platform having hand grips are included.
Figure 5C:
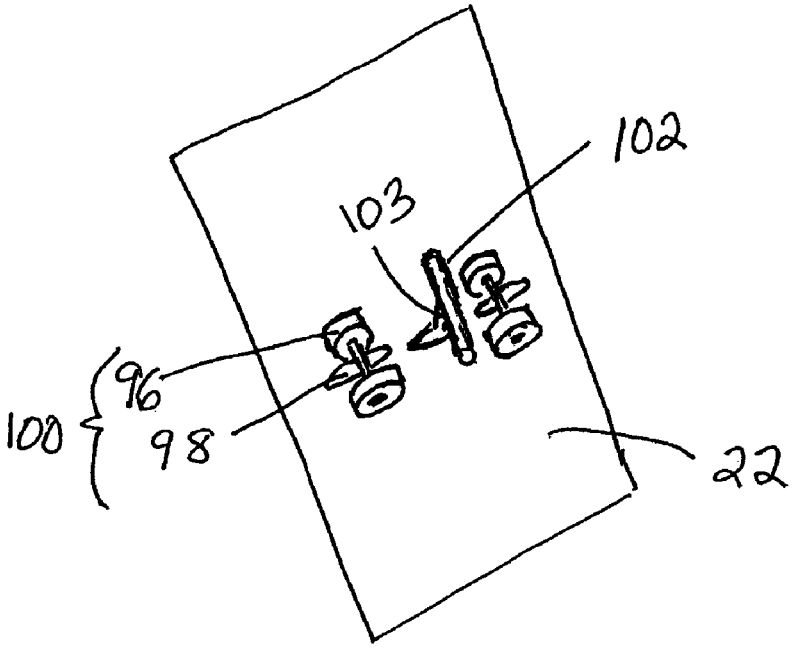
FIG. 5C is a perspective view of the underside of the sliding platform of FIG. 5A having a sliding mechanism adapted to slide along a single track member.

With reference to FIGS. 5A-C, there is illustrated another embodiment of the stretching and exercise apparatus 10. In this embodiment, a single track member 14 is employed. The track member 14 may be stabilized by stabilizing members 50, preferably positioned along the proximal 26 and distal 30 end portions of the track member 14. There is also preferably a central stabilizing member 62, located at or near the middle of the track member 14. In one particularly preferred embodiment, the stabilizing members 50, 62 include floor rests 90, which may comprise a cushioning material, such as a natural or synthetic rubber, polymer, or natural or synthetic textile. Those skilled in the art will readily appreciate the numerous alternatives for providing contact with the floor, preferably resistant to slipping or sliding in response to the forces generated during use of the apparatus. In one embodiment, the floor rests 90 may include a means for permanently or removeably affixing the apparatus to the floor (e.g., bolts, screws, or other fastening mechanisms known in the art).

The stabilizing members 50, 62 preferably include a fastening means 92 for securing the track member 14 to the stabilizing members. In one embodiment, the fastening means 92 is a deformable receiving cup adapted to receive and secure the track member 14. The deformable receiving cup may be formed of a rubber or other deformable material known in the art. One advantage of a deformable receiving cup as the fastening means 92 is that the deformable material may absorb shock and promote smooth, quiet sliding/functioning of the apparatus 10. Of course the fastening means 92 may include permanent (e.g., welding) and/or removeable (e.g., screws and nuts) attachment structures to affix the track member 14 to the stabilizing members 50, 62.

In one preferred embodiment, illustrated in FIG. 5A, one or more of the stabilizing members 50 and/or 62 may also be configured to support hand rails 18, comprising raised portions 86 on vertical supports 82. Preferably the hand rails have heights and distal-proximal lengths that are adjustable using conventional slide and lock mechanisms on the stabilizing member 62 and the vertical supports 82. Such slide and lock mechanisms are used extensively to produce adjustable height in exercise equipment. See, e.g., U.S. Pat. No. 4,817,943, which is hereby incorporated by reference in its entirety.

In one variation to the single track embodiment shown in FIG. 5B, one or more of the sliding platforms 22 may include hand grips 94. The grips may be simple raised bars, as illustrated, or may be configured in any other shape to provide ergonomic gripping without placing undue stresses on the wrist.

The sliding platform 22 in the single track embodiment may be configured to slide or roll up and down the track 14 with minimal friction. Many structures and mechanisms will allow the sliding, including a mounting member that slideably engages the track. (See, e.g., U.S. Pat. No. 4,817,943.) In one preferred embodiment, illustrated in FIG. 5C, the platform 22 may be fitted with ball bearing wheels 96 attached via a truck member 98 to the bottom of the platform. For example, a skateboard truck 100 can provide quiet, smooth, low-friction rolling across the surface of the track 14. In this embodiment, the trucks 100 may be modified so as not to allow lateral turning, aligning the wheels with the track member 14. A guide pin 103 with a capture bar 102 may be employed to engage the slot 54 in the track member 14. This capture bar 102 may include means, such as for example bearings or wheels, to minimize friction as the capture bar 102 slides within the slot 54. Alternatively, or in addition, the capture bar 102 may be constructed from a plastic material that generates minimal friction upon sliding. The track member 14 preferably, includes an access slot 93 (which can be located anywhere along the track slot 54 but is illustrated at the center). The access slot 93 is preferably perpendicular to the track slot 54, thereby allowing the sliding platforms to conveniently engage the track slot 54 or be removed from the apparatus 10. Of course, the actual sliding or rolling mechanism and associated structures may include other mechanisms known in the art.

The apparatus 10 may be constructed from any of a number of suitable materials, including plastics, metals, alloys, and other rigid or semi-rigid materials, many of which are commonly used in the construction of exercise machines.

FIGS. 6-9A illustrate different methods of exercising and stretching using the apparatus 10 described above with reference to FIGS. 1-4. Of course, these methods are illustrative, and other methods of using this machine are contemplated by the inventor. In addition to strengthening and stretching the legs, the apparatus 10 may further be adapted to enable an individual to perform a variety of exercises to increase overall strength and cardiovascular conditioning. For example, the stretching and exercise apparatus 10 may be further utilized to perform abdominal strengthening exercises, rowing exercises, dipping exercises and push-up exercises, which may simultaneously strengthen an individual's core.

Figure 6:
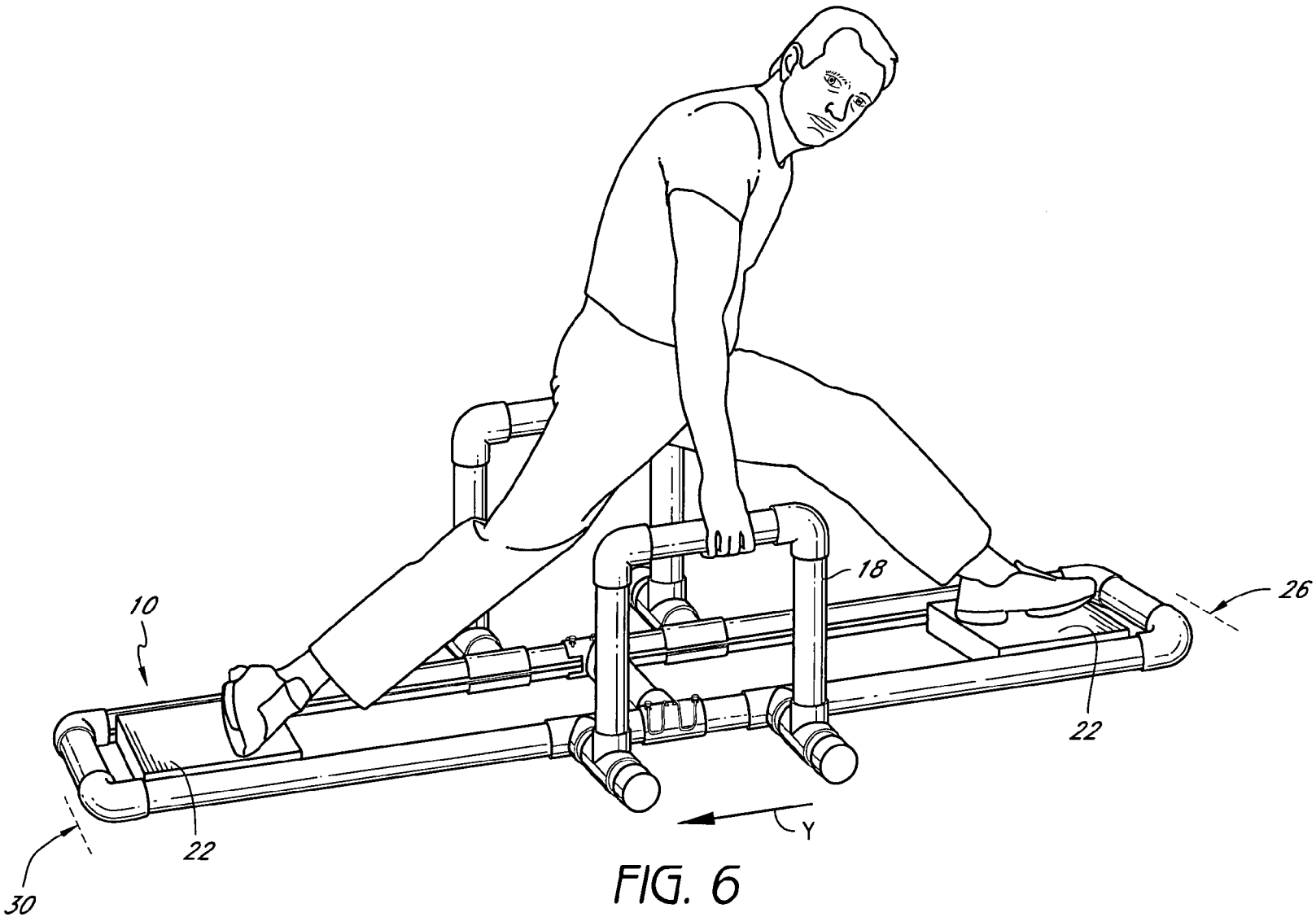
FIGS. 6 and 6A are perspective views of a user performing one exemplary exercise on the apparatus.
Figure 6A:
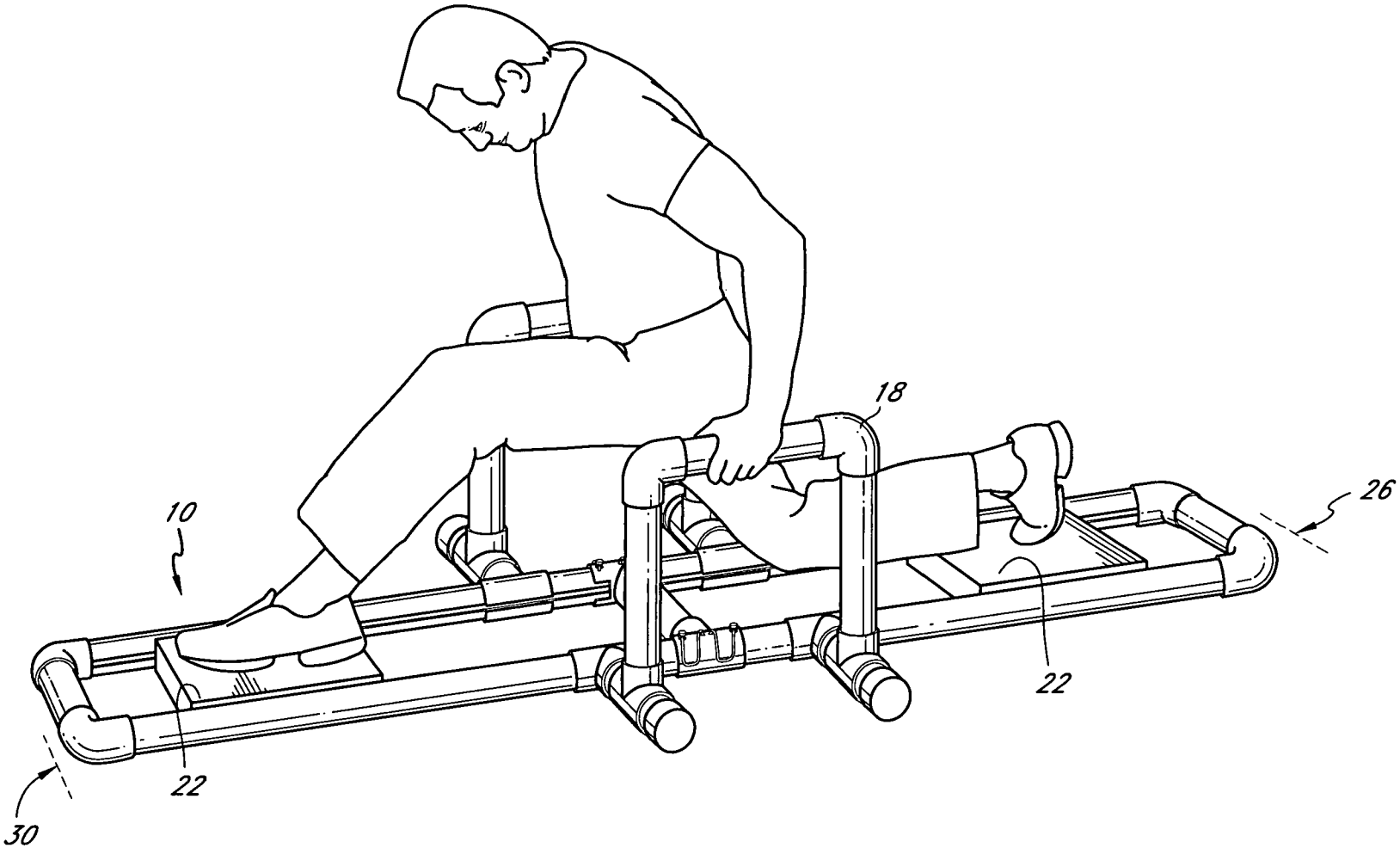

In one method of using the stretching and exercise apparatus 10 shown in FIGS. 6 and 6A, an individual may place one of his or her feet on each sliding platform 22. In order to complete a simple stretch (as shown in FIG. 6), the individual may then grasp the hand rails 18 and abduct his or her legs such that the individual's feet exert pressure against the sliding platforms 22. This pressure slides the platforms 22 towards the proximal and distal sides 26, 30 of the apparatus 10 to thus stretch and strengthen the individual's leg muscles, and in particular, the soleus, gastrocnemius, semitendinosis, biceps, femoris, rectus femoris, gracilis, adductor longus, adductor magnus, and vastus medialis muscle and muscle groups thereof. The individual is thereby able to assume a "split" type position on the apparatus 10. In one embodiment, shown in FIG. 6, the individual's hips are oriented such that they are parallel to the longitudinal axis Y in a "front split" position, while in other embodiments, the individual's hips may be oriented parallel to the anterior-posterior axis in a "side split" position. In a preferred embodiment, the individual performs a "front split" with the foot in front of his or her hips oriented parallel to the longitudinal axis Y, and the other foot oriented parallel to the anterior-posterior axis. This preferred method of stretching stretches different muscles in each leg and reduces joint stresses associated with other stretching exercises.

In order to control the extent of the stretch, the individual uses the hand rails 18 to partially support his or her body weight, thereby exercising his or her upper body and core while stretching his or her lower body. The user may then adduct his or her legs such that the individual's feet exert pressure against the sliding platforms 22 to slide them towards the midpoint P of the apparatus 10 to thus stretch and strengthen the individual's leg muscles. This movement may, of course, be reversed in order to stretch and strengthen both legs evenly.

In FIG. 6A, this stretching motion in the lower body is accompanied with a lowering and flexing of the upper body in order to strengthen and tone the abdomen, lower and upper back, obliques and transversus abdominus, triceps, biceps, wrists, forearms, shoulders and chest muscles. FIG. 6A shows a person (from a different angle) at one position in the exercise, while FIG. 6 shows the individual at another position in the exercise. By moving between these two positions, the individual can strengthen his or her core, as well as the muscle groups listed above.

Figure 7:
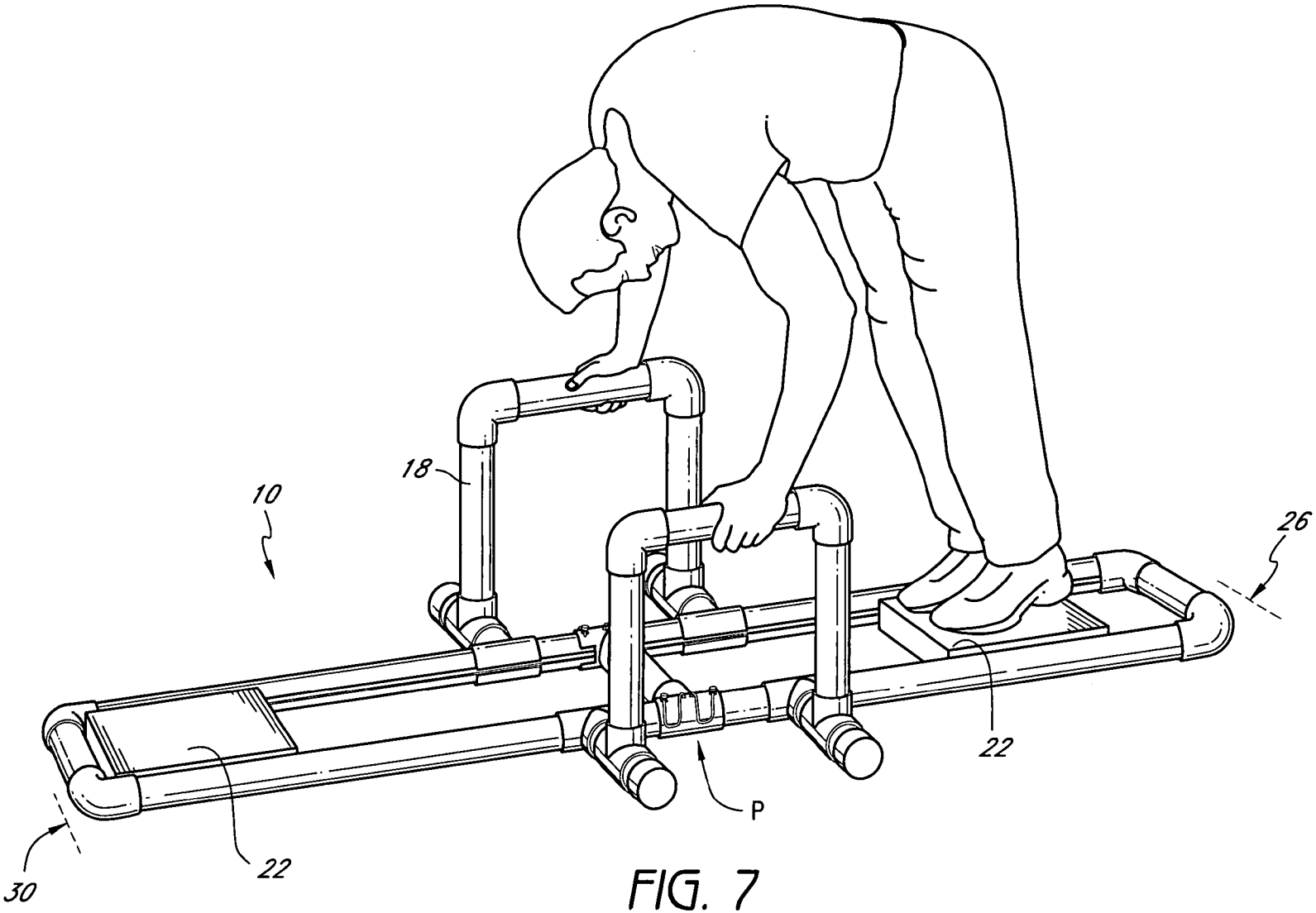
FIGS. 7 and 7A are perspective views of a user performing another exemplary exercise on the apparatus.
Figure 7A:
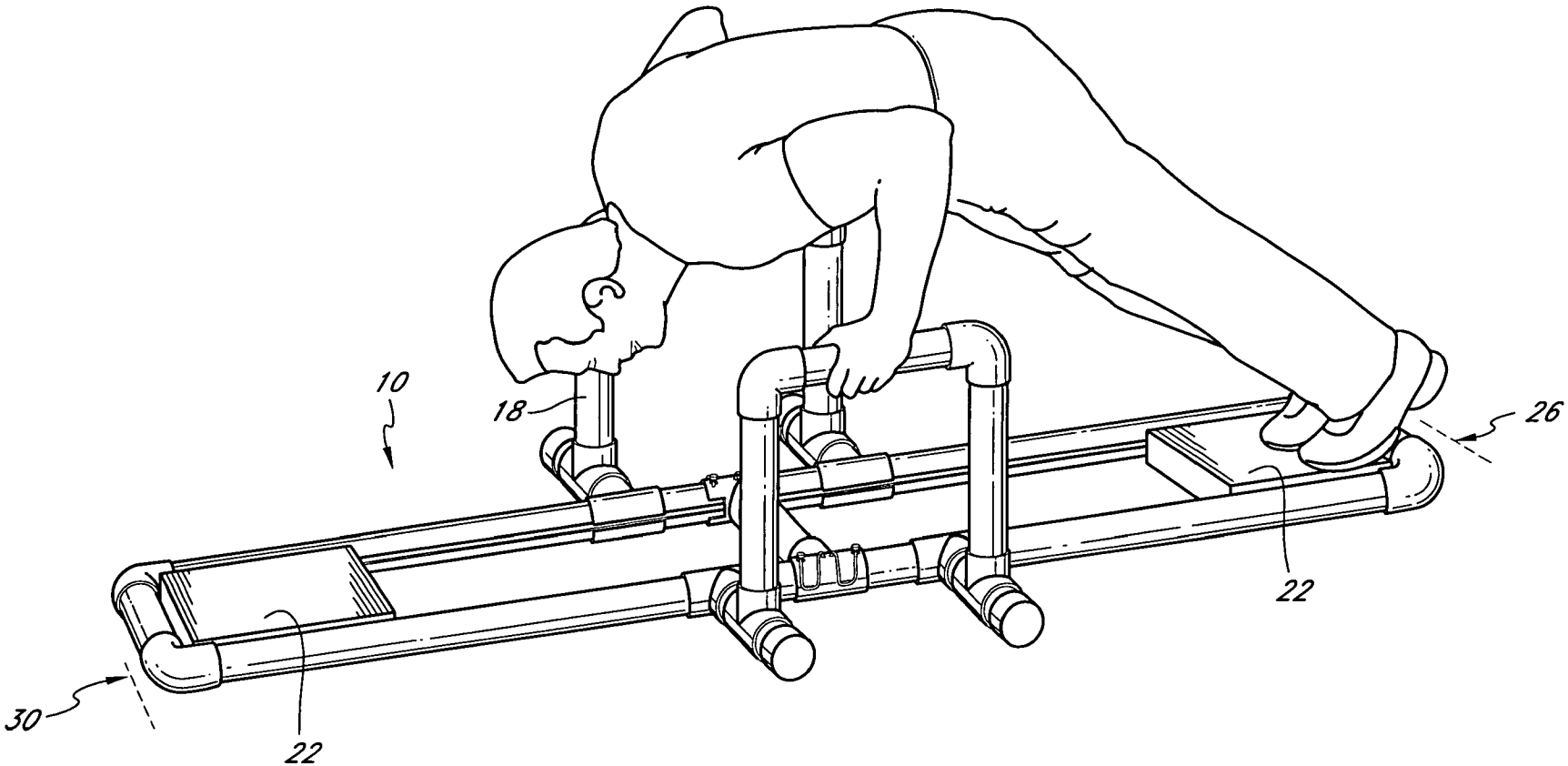

In FIGS. 7 and 7A, another method of using the stretching and exercise apparatus 10 is shown, in which both feet of a user are positioned on one of the sliding platforms 22. This exercise technique may be used in order to strengthen and tone the abdomen, lower and upper back, obliques and transversus abdominus, triceps, biceps, wrists, forearms, shoulders, chest, and major leg muscles. FIG. 7 shows a person at one position in the exercise, in which the abdominal muscles are tightened to draw the legs and thereby the sliding platform 22 in towards the midpoint P. FIG. 7A shows a person at another position in the exercise, in which the arms are bent and the legs are extended, pushing the sliding platform 22 towards the proximal side 26 of the apparatus 10. By moving between these two positions, the individual can strengthen his or her core, as well as the muscle groups listed above.

Figure 8:
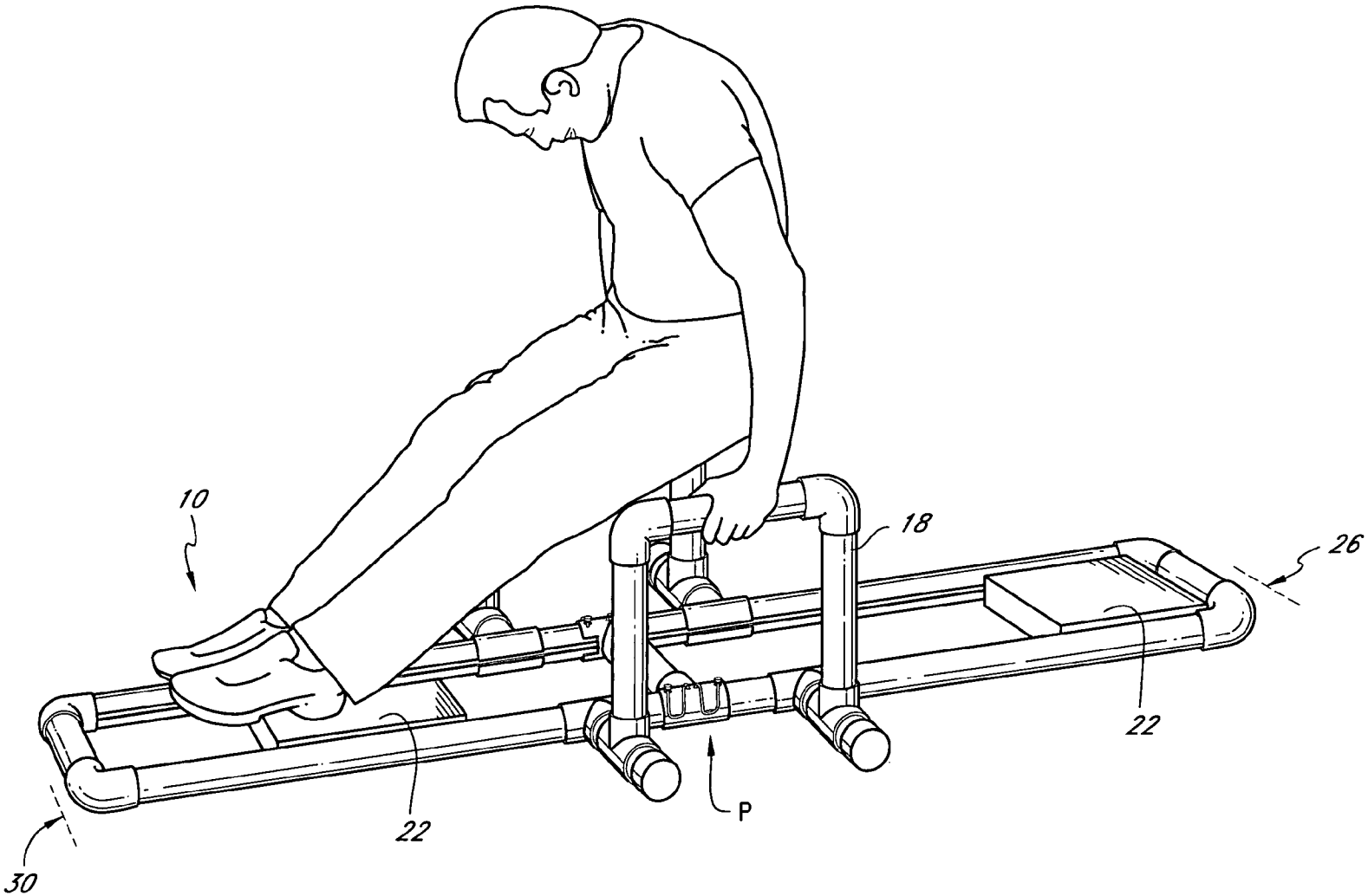
FIGS. 8 and 8A are perspective views of a user performing another exemplary exercise on the apparatus.
Figure 8A:
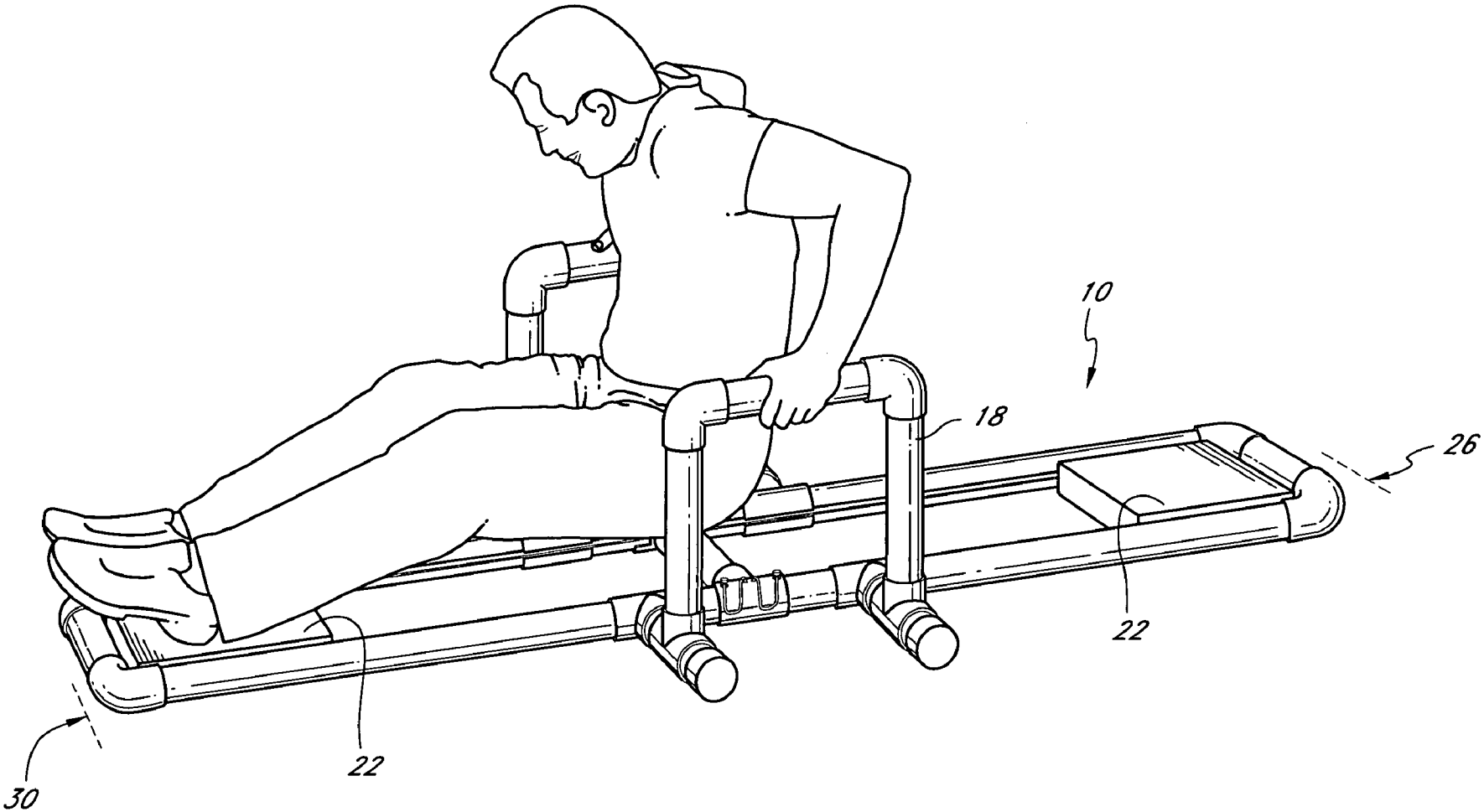

In FIGS. 8 and 8A, another method of using the stretching and exercise apparatus 10 is shown, in which both feet of a user are positioned on one of the sliding platforms 22. This exercise technique may be used in order to strengthen and tone the abdomen, lower and upper back, obliques and transversus abdominus, triceps, biceps, wrists, forearms, shoulders, chest, and major leg muscles. FIG. 8 shows a person at one position in the exercise, in which the abdominal muscles are tightened to draw the legs and thereby the sliding platform 22 in towards the midpoint P. FIG. 8A shows a person at another position in the exercise, in which the arms are bent and the legs are extended, pushing the sliding platform 22 towards the distal side 30 of the apparatus 10. By moving between these two positions, the individual can strengthen his or her core, as well as the muscle groups listed above.

Figure 9:
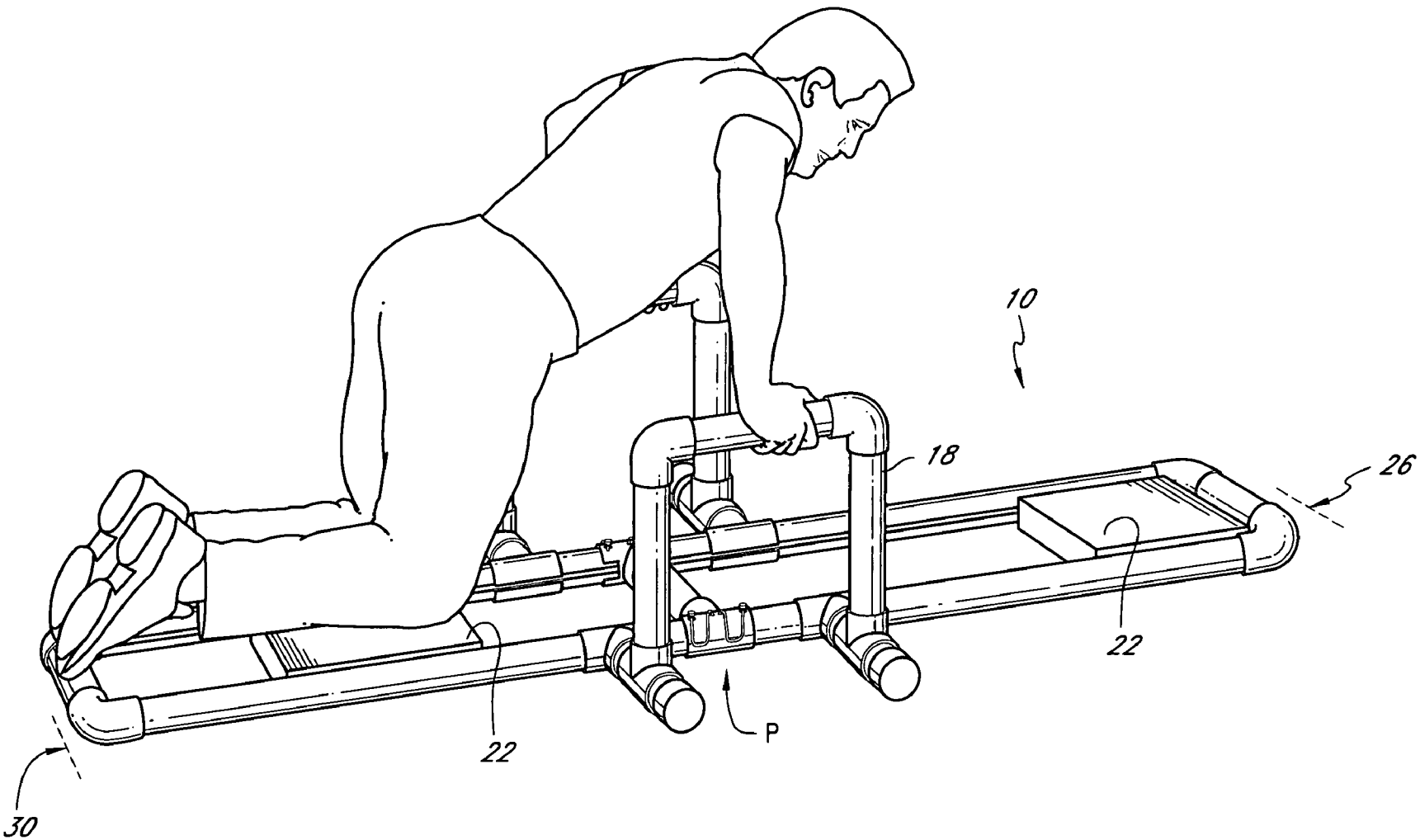
FIGS. 9 and 9A are perspective views of a user performing another exemplary exercise on the apparatus.
Figure 9A:
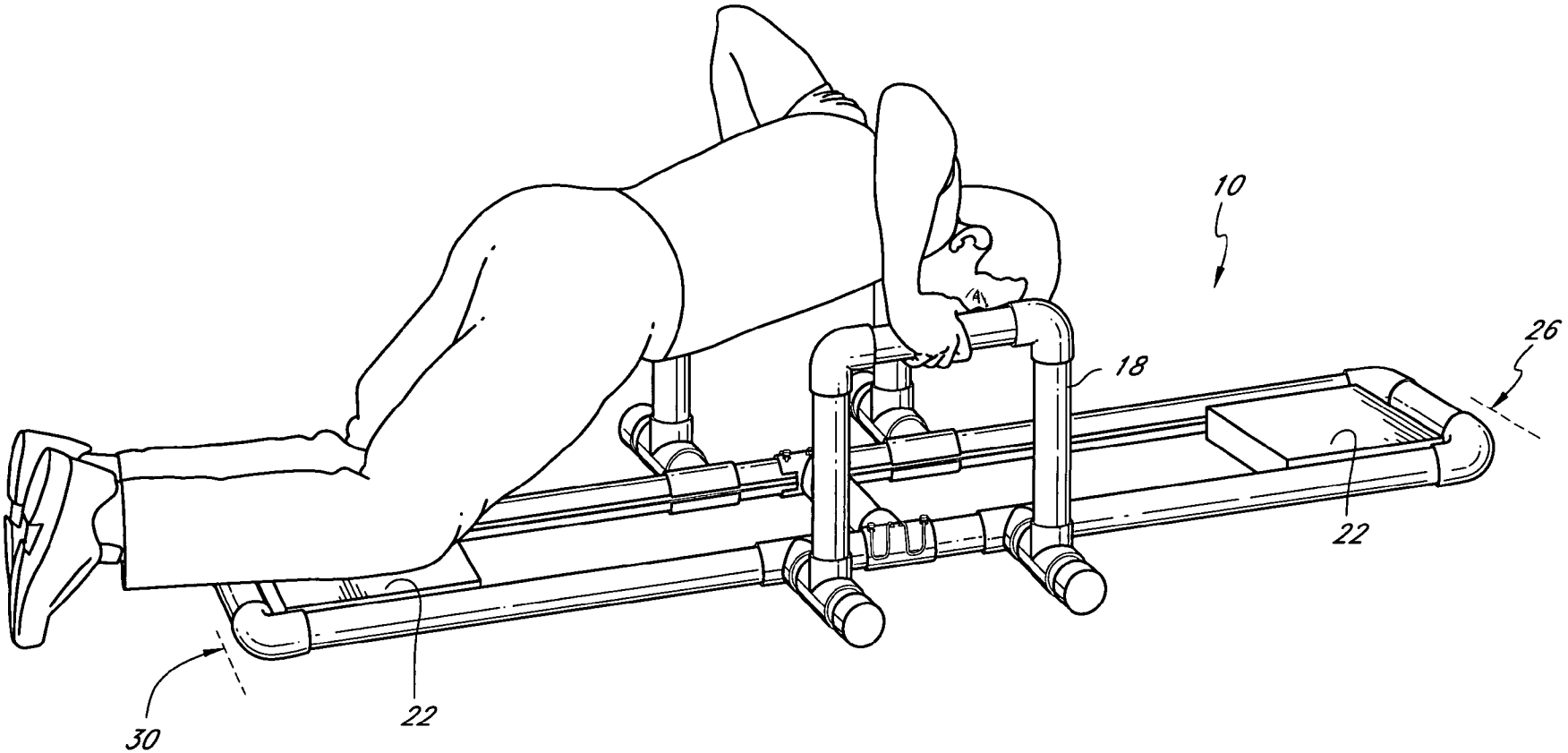

In FIGS. 9 and 9A, another method of using the stretching and exercise apparatus 10 is shown, in which both knees of a user are positioned on one of the sliding platforms 22. This exercise technique may be used in order to strengthen and tone the abdomen, lower and upper back, obliques and transversus abdominus, triceps, biceps, wrists, forearms, shoulders, chest, and major leg muscles. FIG. 9 shows a person at one position in the exercise, in which the abdominal muscles are tightened to draw the legs and thereby the sliding platform 22 in towards the midpoint P. FIG. 9A shows a person at another position in the exercise, in which the arms are bent and the legs are extended, pushing the sliding platform 22 towards the distal side 30 of the apparatus 10. By moving between these two positions, the individual can strengthen his or her core, as well as the muscle groups listed above.

Figure 10:
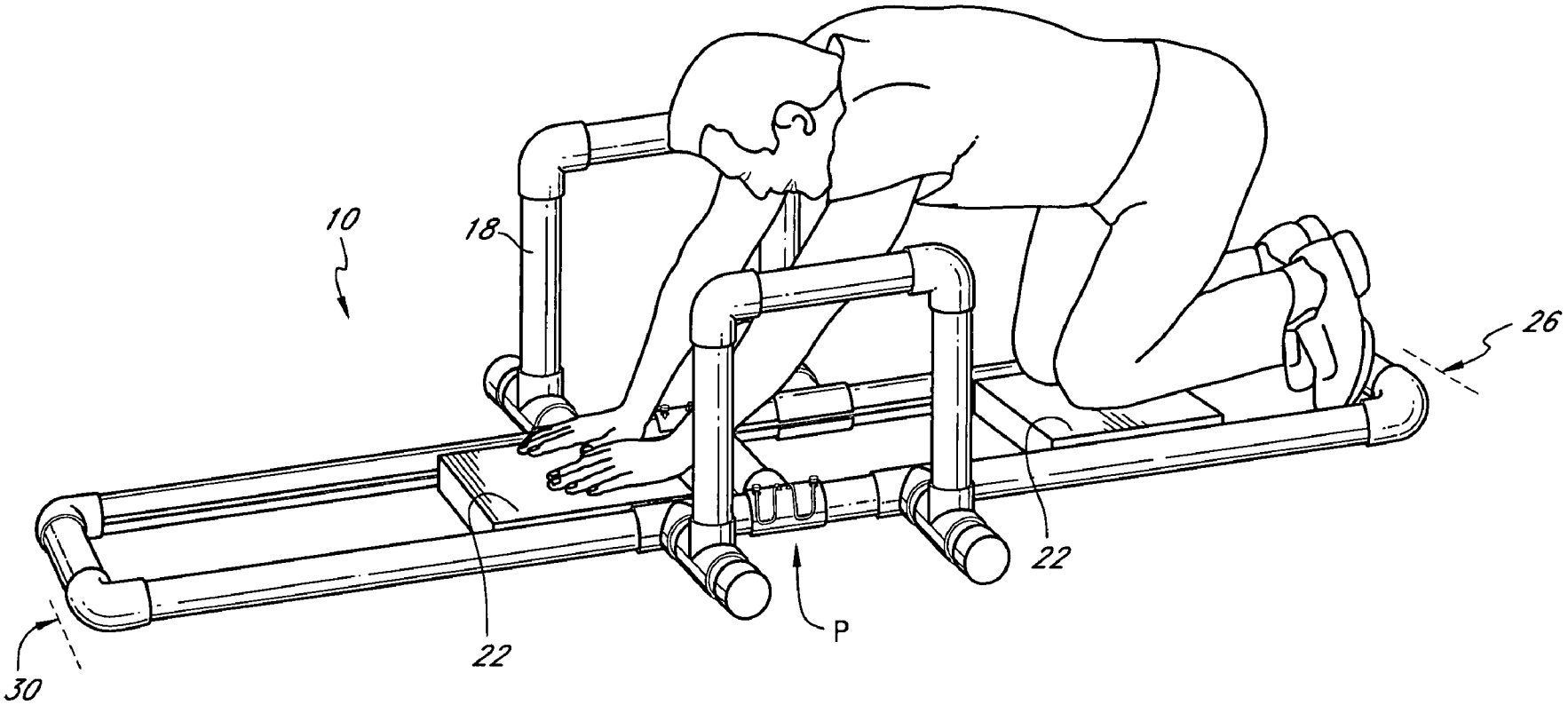
FIGS. 10 and 10A are perspective views of a user performing another exemplary exercise on the apparatus.
Figure 10A:
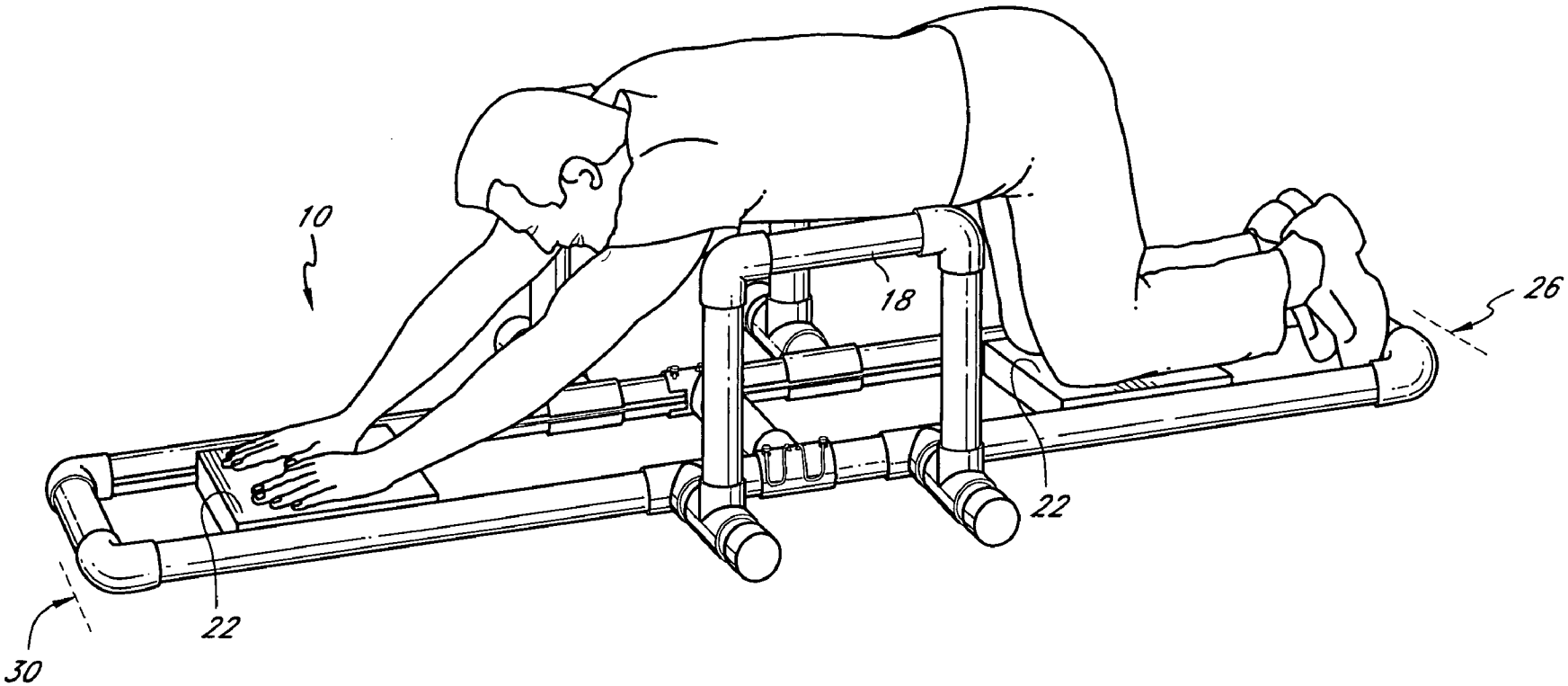

In FIGS. 10 and 10A, another method of using the stretching and exercise apparatus 10 is shown, in which both knees of a user are positioned on one of the sliding platforms 22, and the hands of the user are positioned on the other of the sliding platforms 22. Although not shown in FIGS. 10 and 10A, a means of grasping the sliding platform 22, such as the hand grips 94 described above, may be used. This exercise technique may be used in order to strengthen and tone the abdomen, lower and upper back, obliques and transversus abdominus, triceps, biceps, wrists, forearms, shoulders, chest, and major leg muscles. FIG. 10 shows a person at one position in the exercise, in which the abdominal muscles are tightened to draw the legs and upper body and thereby the sliding platforms 22 in towards the midpoint P. FIG. 10A shows a person at another position in the exercise, in which the arms are extended beyond the head and the legs are extended, pushing the sliding platforms 22 towards the proximal and distal sides 26, 30 of the apparatus 10. By moving between these two positions, the individual can strengthen his or her core, as well as the muscle groups listed above.

The foregoing examples and description of the preferred embodiments should be taken as illustrating, rather than as limiting, the present invention as defined by the claims. As will be readily appreciated, numerous variations and combinations of the features set forth above can be utilized without departing from the present invention as set forth in the claims. Such variations are not regarded as a departure from the spirit and scope of the invention, and all such modifications are intended to be included within the scope of the following claims.

What is claimed is:

1. A stretching and exercise apparatus, comprising:

two elongate track members, each comprising a hollow cylinder, wherein said hollow cylinder comprises a slot facing an interior of said apparatus;

a pair of platforms engaged to the elongate track members, wherein each platforms comprises four pegs, two of which are configured to fit and slide within each said slot, and wherein each peg comprises a wheel configured to rotate about the peg and within the hollow cylinder and a diameter of said wheel is larger than a height of said slot;

a pair of hand rails centered along the longitudinal direction of said elongate track members, wherein each hand rail comprises two vertical supports having an adjustable length;

four horizontal support members comprising hollow cylinders, two of which extend in a transverse outward direction from each of said two elongate track members, wherein each of said horizontal support members is connected with one of said vertical supports;

four track connection members having a T-shape in top view and comprising tubular components, said tubular components having an inner diameter larger than an outer diameter of said elongate track members and said horizontal support members so as to engage with said elongate track members and horizontal support members in sliding communication, said track connection members further comprising a slot formed so as to coincide with said slot of the elongate track member when said elongate track member is engaged within said track connection member; and further consisting of an elongate stabilizing member extending between said two elongate track members at a midpoint along the longitudinal direction of said track members, wherein said elongate stabilizing member is configured to be a barrier to the sliding of said pegs within said slots.

2. The stretching and exercise apparatus of claim 1, wherein the pair of hand rails are configured to support a user.

3. The stretching and exercise apparatus of claim 1, wherein the pair of hand rails further comprises a substantially horizontal, raised portion.

4. The stretching and exercise apparatus of claim 3, wherein the horizontal portion is raised between two and three feet from the elongate track member.

5. The stretching and exercise apparatus of claim 1, wherein each platform is configured to receive both feet, both knees, or both hands of a user placed side by side.

6. The stretching and exercise apparatus of claim 1, wherein at least one of the pair of platforms comprises a one foot by one foot platform.

7. The stretching and exercise apparatus of claim 1, wherein said two elongate track members comprise polyvinyl chloride.

8. A method of stretching and exercising for a user, comprising:

providing the apparatus of claim 1;

moving the platforms away from one another; and moving the platforms toward one another.

9. The method of claim 8, wherein the steps of moving the platforms away from one another and toward one another further comprise:

placing one foot on one of the platforms and another foot on another of the platforms;

grasping the hand rails;

abducting a user's legs to slide the platforms away from one another; and adducting the user's legs to slide the platforms toward one another.

10. The method of claim 8, wherein the steps of moving the platforms away from one another and toward one another further comprise:

placing both feet on one of the platforms;

grasping the hand rails;

extending both feet and bending a user's arms to slide the one of the platforms away from the other of the platforms; and drawing both feet in while straightening the user's arms to slide the one of the platforms toward the other of the platforms.

11. The method of claim 8, wherein the steps of moving the platforms away from one another and toward one another further comprise:

placing both knees on one of the platforms and both hands on another of the platforms;

separating the user's hands and knees to slide the platforms away from one another; and bringing the user's hands and knees together to slide the platforms toward one another.

12. The method of claim 8, further comprising:

placing both feet, both knees, or both hands of a user side by side on one of said platforms; and sliding said platform to stretch and/or exercise the body of said user.

* * * * *